US005501023A

United States Patent [19]

Miotto

[11] Patent Number: 5,501,023

[45] Date of Patent: Mar. 26, 1996

[54] SECURING DEVICE, PARTICULARLY FOR SPORTS SHOES

[75] Inventor: Onorio Miotto, Santo Stefano di Valdobbiadene, Italy

[73] Assignee: AM S.r.l., Monsigo di Moriago Della Battaglia, Italy

[21] Appl. No.: 195,105

[22] Filed: Feb. 14, 1994

[30] Foreign Application Priority Data

Apr. 15, 1993 [IT] Italy ..... TV93U0019

[51] Int. Cl.[6] ..... A43B 5/04

[52] U.S. Cl. ..... 36/50.5; 36/117; 24/71 SK

[58] Field of Search ..... 36/50.5, 117; 24/68 SK, 24/70 SK, 71 SK

[56] References Cited

U.S. PATENT DOCUMENTS

| | | | |
|---|---|---|---|
| 260,852 | 7/1882 | Dieter | 24/68 SK |
| 448,893 | 3/1891 | Thompson | 24/68 SK X |
| 627,834 | 6/1899 | Wallen | 24/71 SK |
| 3,295,177 | 1/1967 | Brueckl . | |
| 3,431,604 | 3/1969 | Everts | 24/68 SK |
| 3,662,435 | 5/1972 | Allsop | 24/70 SK |
| 3,805,334 | 4/1974 | Graup | 24/70 SK |
| 4,011,634 | 3/1977 | Olivieri | 24/70 SK |
| 4,253,217 | 3/1981 | Marzocchi | 24/71 SK X |
| 4,470,175 | 9/1984 | Chiarella | 24/71 SK X |
| 4,575,958 | 3/1986 | Arieh et al. | 36/50.5 X |
| 4,765,069 | 8/1988 | Baggio et al. | 36/50.5 X |

FOREIGN PATENT DOCUMENTS

| | | | |
|---|---|---|---|
| 1340134 | 9/1963 | France | 24/70 SK |
| 2410449 | 6/1979 | France . | |
| 0017908 | 6/1907 | Norway | 24/71 SK |
| 596784 | 3/1978 | Switzerland . | |

*Primary Examiner*—Bryon P. Gehman
*Assistant Examiner*—Ted Kavanaugh
*Attorney, Agent, or Firm*—Guido Modiano; Albert Josif

[57] ABSTRACT

Securing device for securing two flap portions of a sports shoe, including: a lever arm with a pair of wings interconnected by a crossbase at one end thereof and provided with pivots at another end thereof; a traction element connectable at one end to a first flap and pivotally connected at another end to a middle zone of the wings of the lever arm; and a baseplate connectable to a second plate and provided with: a pair of protruding curved teeth at one end of the baseplate for pivotally accommodating the pivots of the lever arm; and a quadrangular protruding lug at another end of the baseplate for catching between the crossbase and wings of the lever arm in a closed position thereof. A pair of seats are provided in the upper surface of the baseplate to the sides of the lug, and the lever arm is provided with a pair of shoulders which engage in the seats when the lever arm is closed. The curved teeth of the baseplate also include first inclined planes which engage, when the lever arm is closed, with complementary inclined planes defined on the lower surface of the lever arm.

10 Claims, 2 Drawing Sheets

SECURING DEVICE, PARTICULARLY FOR SPORTS SHOES

BACKGROUND OF THE INVENTION

The present invention relates to a securing device particularly usable in sports shoes such as ski boots, ice skates or roller skates.

Many kinds of levers used to secure the quarters, the shell or the uppers of sports shoes, such as for example ski boots or ice skates and roller skates, are currently known.

U.S. Pat. No. 3,295,177 discloses a securing lever for a boot having a lever arm that is provided with a set of teeth in a downward region and is arrangeable, at one end, at a shoulder associated with the upper and protruding along a plane which is inclined with respect to said upper.

The lever arm is connected to a ring for securing a flap by means of an adapted metallic plate that keeps the ring facing the set of teeth.

This embodiment, in addition to requiring various steps for the assembly of the components of the lever which increase its production costs, does not have optimum impact-resistance characteristics, especially against impacts occurring along an axis which is transverse to said lever arm.

Such impacts can in fact disengage the lever arm from the shoulder, consequently eliminating the securing action, or break the components.

Swiss patent no. 596,784 discloses a ski boot provided with levers that comprise a lever arm having, in a downward region, a set of teeth with which a metal ring interacts; at its other end, said ring interacts with the boot flap to be secured or with quarter securing bands.

The lever arm has, at one end, a pair of tabs between which a pivot for pivoting the lever arm is located; said pivot is arrangeable at an adapted seat formed on an elastically deformable tab.

Even this embodiment has drawbacks, since any impact affecting the lever arm axially may cause the pivot to leave its seat, thus causing disengagement or breakage.

The possible use of a screw to fix the elastically deformable tab would only partially solve the problem, since it would create a weaker region that might give way if stressed repeatedly.

Furthermore, the use of a screw locks the lever arm in its position.

Similarly, impacts affecting the lever arm transversely to its longitudinal median axis might entail the breakage of the elastically deformable tab, thus eliminating the securing action.

French patent no. 2,410,449 discloses an improved fixing device for ski boots and the like, which comprises a lever arm provided with a set of teeth in a downward region and, on the side opposite to the side gripped by the user, a wedge-like element which interacts with a complementarily shaped seat formed at a tab protruding from the shell.

As an alternative it is possible to use a pivot.

These embodiments have some of the drawbacks described above, since there is still the problem that they are unable to optimally withstand impacts affecting the lever arm, as said arm can disengage from the tab and thus release the shell or the quarters.

It is to be noted that during sports practice these impacts, with the snow or with the poles placed along the racing slope in the case of skiing, or with the ground or the surface of the track in the case of skating, can be very frequent.

SUMMARY OF THE INVENTION

A principal object of the present invention is therefore to eliminate the drawbacks described above in known types, providing a lever that allows to achieve optimum securing of the shell or of at least one quarter or of the upper of a sports shoe and has, at the same time, optimum characteristics of resistance to accidental impacts.

Within the scope of the above object, another important object is to provide a lever that allows to withstand in an optimum manner impacts occurring both along a longitudinal axis and along a transverse axis with respect to said lever.

Another important object is to provide a lever which is reliable and safe in use, structurally simple, and easy to industrialize.

Another important object is to provide a lever which allows rapid and easy securing and release.

Another object is to provide a lever which has low manufacturing costs.

With these and other objects in view, there is provided, according to the present invention, a securing device, particularly for sports shoes, which comprises a lever to which the end of a traction element is idly pivoted, the other end of said traction element being associable with said shoe, characterized in that said lever arm has first means for temporary pivoting to engagement means provided on a baseplate that is associable with said shoe, second means for withstanding axial stresses, and third means for withstanding transverse stresses.

BRIEF DESCRIPTION OF THE DRAWINGS

Further characteristics and advantages of the present invention will become apparent from the following detailed description of a particular embodiment thereof, illustrated only by way of non-limitative example in the accompanying drawings, wherein.

DESCRIPTION OF THE PREFERRED EMBODIMENTS

Figure 1:
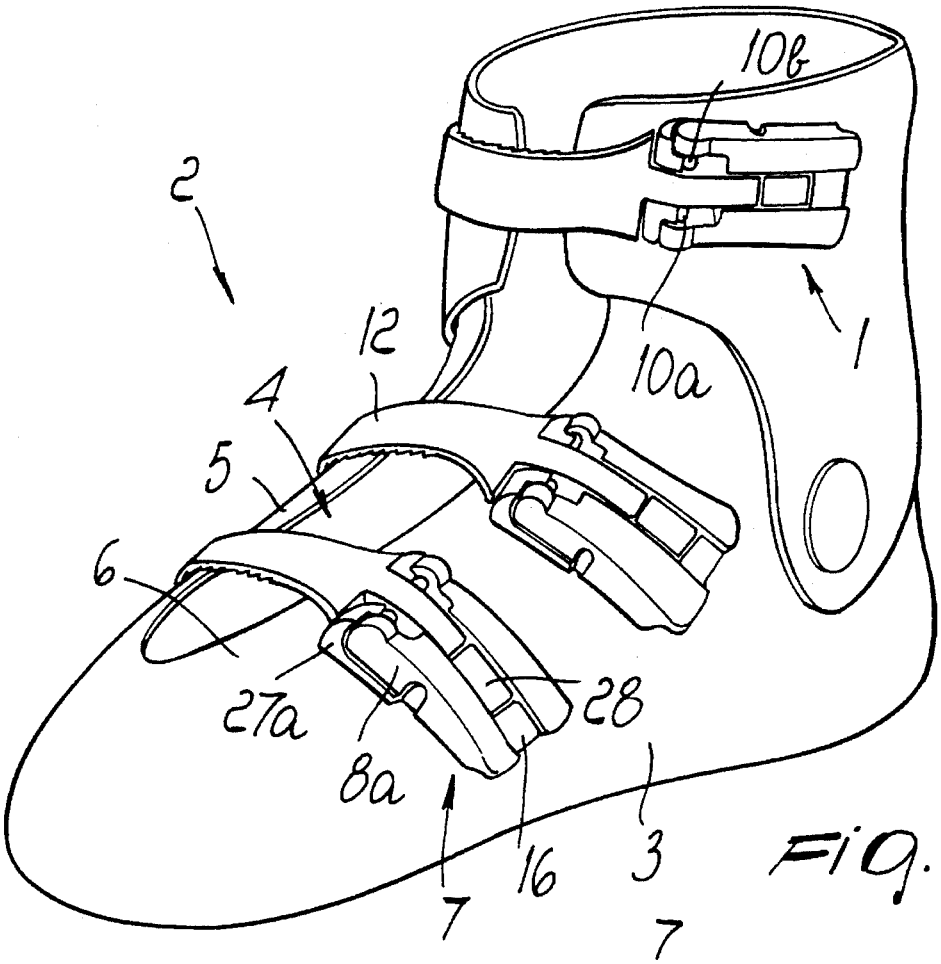
FIG. 1 is a lateral perspective view of the lever applied to a shoe.
Figure 2:
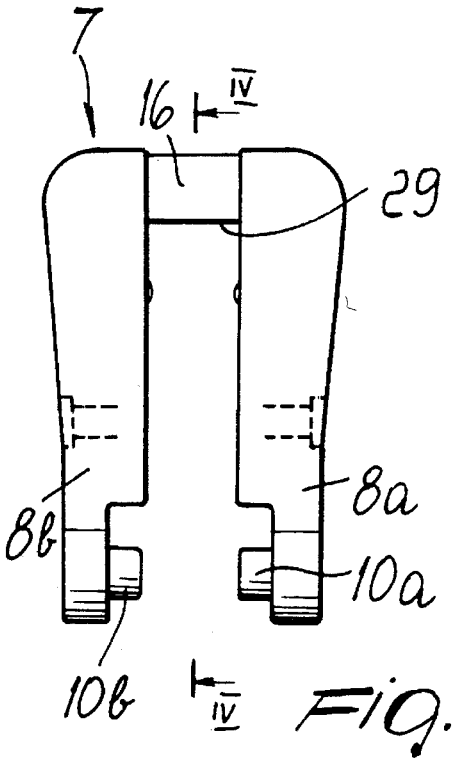
FIG. 2 is a top view of the lever.
Figure 3:
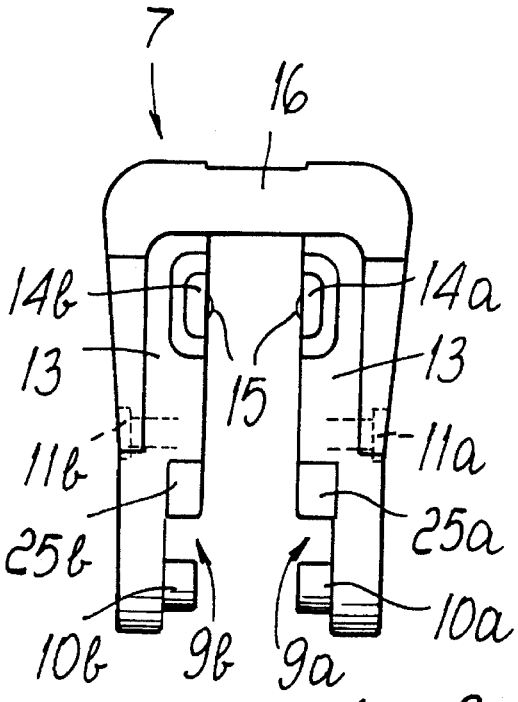
FIG. 3 is a bottom view of the lever.
Figure 4:
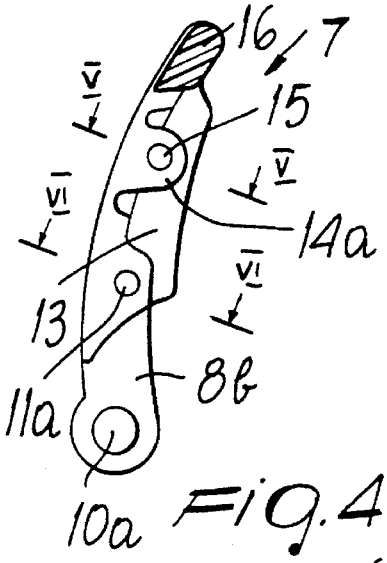
FIG. 4 is a sectional view, taken along the plane IV—IV of FIG. 2.
Figure 5:
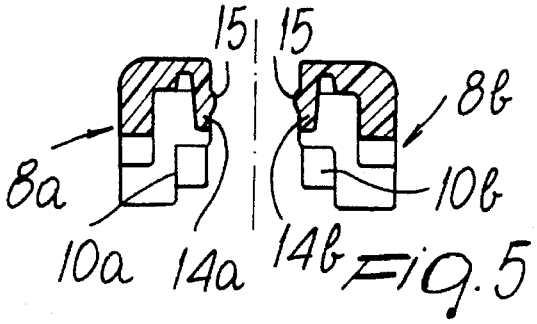
FIG. 5 is a sectional view, taken along the plane V—V of FIG. 4.
Figure 6:
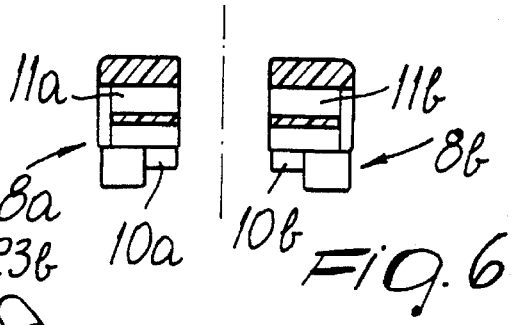
FIG. 6 is a sectional view, taken along the plane VI—VI of FIG. 4.
Figure 7:
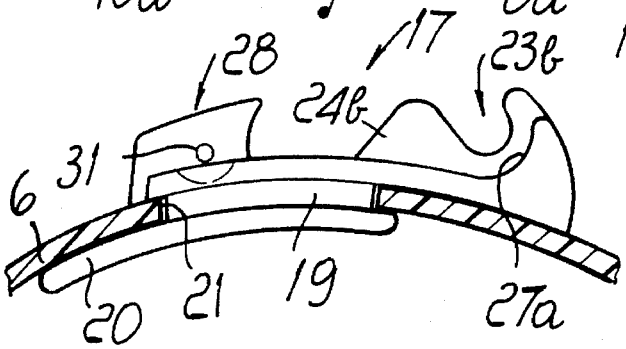
FIG. 7 is a side view of the baseplate associated with the shoe.
Figure 8:
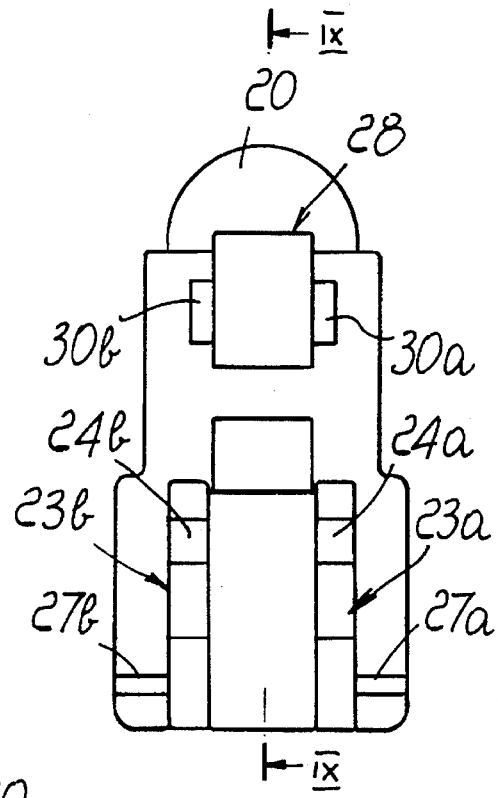
FIG. 8 is a top view of the baseplate.
Figure 9:
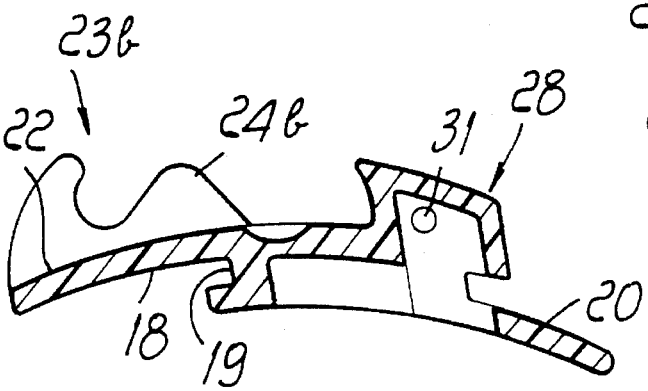
FIG. 9 is a sectional view, taken along the plane IX—IX of FIG. 8.

With reference to the above figures, the reference numeral 1 generally designates the securing device particularly usable for sports shoes 2, such as for example ski boots or skates which comprise a shell 3 having a front opening 4 and accordingly a first flap 5 and a second flap 6 to be mutually secured.

As an alternative, the lever could be used to secure a quarter or quarters associated with the shell or otherwise secure the flaps of an upper.

The lever 1 comprises a lever arm 7 constituted by a single U-shaped body in which the tips of the wings 8*a* and 8*b* have a curved and preferably half-cylindrical shape.

Thinner regions or recesses 9*a* and 9*b* are formed at the mutually facing surfaces of the tips of the wings 8*a* and 8*b;* a pair of cylindrical pivots 10*a* and 10*b* protrudes, coaxially to said tips, at said recesses, said pivots being approximately as high as the recesses are deep and having the same axis.

A pair of identical first holes 11*a* and 11*b* is furthermore formed between the wings 8*a* and 8*b* of the lever arm 7 in an intermediate region adjacent to the pair of pivots 10*a* and 10*b;* said holes have the same axis, and a pivot for pivoting one end of a traction element, such as for example a toothed band 12, is arrangeable between said holes. The other end of the traction element 12 is associable with the first flap 5, for example by known means such as rivets.

A pair of mutually parallel first shoulders 14*a* and 14*b* furthermore protrudes at the wings 8*a* and 8*b* at right angles thereto starting from their lower surface 13; anti-release safety means, constituted by engagement protrusions or first lugs 15, advantageously protrude from the facing surfaces of said shoulders.

The first shoulders 14*a* and 14*b* protrude in the interspace between the pair of first holes 11*a* and 11*b* and the base 16 connecting the wings 8*a* and 8*b* and opposite to the end provided with the pair of pivots 10*a* and 10*b*.

Said pivots constitute the first means for the temporary pivoting of the lever arm, which interact with engagement means formed on a baseplate 17 having a longitudinal extension and associable for example at the second flap 6; the end of the band 12 that does not interact with the lever arm 7 is associable at the first flap 5.

A raised portion 19 protrudes from the lower surface 18 of the baseplate 17, and its height is approximately equal to the thickness of the second flap 6; a first tab 20 is associated with said raised portion and has the purpose of keeping the baseplate associated with the first flap once it has been inserted at an adapted opening 21 formed on said flap.

A pair of curved teeth 23*a* and 23*b* protrudes from the upper surface 22 of the baseplate 17 at one end; said teeth have an essentially S-shaped cross-section, are suitable to accommodate the pair of pivots 10*a* and 10*b,* and form first inclined planes 24*a* and 24*b,* for blending with the outer surface 22, which are suitable to abut against complementarily shaped second inclined planes 25*a* and 25*b* formed below the lever arm 7 proximate to the pair of pivots 10*a* and 10*b*.

A pair of second curved shoulders 27*a* and 27*b* is furthermore formed on the baseplate 17; said shoulders are shaped complementarily to the ends of the wings 8*a* and 8*b* of the lever arm 7, which are also curved.

Thus, the location of the pair of pivots 10*a* and 10*b* at the pair of curved teeth 23*a* and 23*b* is such as to force the tips of the wings 8*a* and 8*b* to interact with the second pair of shoulders 27*a* and 27*b* which are shaped complementarily thereto.

A second lug 28 furthermore protrudes from the upper surface 22 of the baseplate 17 on the side opposite to the pair of curved teeth 23*a* and 23*b* and at the interspace between them; said second lug is approximately as wide as the interspace between the wings 8*a* and 8*b* of the lever arm 7, and its length is such that it interacts at one end with the inner side 29 of the base 16 when the lever arm is closed.

A pair of seats 30*a* and 30*b* is formed laterally to the second lug 28 on the upper surface 22 of the baseplate 17; when the lever arm is closed, said seats accommodate the pair of first shoulders 14*a* and 14*b* in which the first lugs 15 advantageously interact with a snap action at adapted recesses 31 formed transversely to the second lug 28.

The second lug 28 constitutes the third means for withstanding lateral stresses by preventing lateral movement of said lever arm 7 with respect to the longitudinal extension of the baseplate 17.

Use of the lever is thus as follows: once the end of the band 12 has been pivoted between the wings 8*a* and 8*b* of the lever arm 7, and once the other end of the band has been rigidly coupled to the second flap to be tightened, the user merely has to arrange the pair of pivots 10*a* and 10*b* at the pair of curved teeth 23*a* and 23*b,* rotating the lever arm so that it secures the band.

This operation is facilitated by the shape of the pair of pivots 10*a* and 10*b,* of the pair of curved teeth 23*a* and 23*b,* of the ends of the wings 8*a* and 8*b* and of the pair of second shoulders 27*a* and 27*b*.

Once the lever arm has been secured, optimum resistance to stresses imparted along the longitudinal axis of said arm is achieved, since the base 16 interacts with one end of the second lug 28, the pair of pivots 10*a* and 10*b* interacts with the pair of curved teeth 23*a* and 23*b,* and the tips of the wings 8*a* and 8*b* interact with the complementarily shaped pair of second shoulders 27*a* and 27*b* protruding from the baseplate; the stress withstood by the pair of pivots 10*a* and 10*b* is thus considerably reduced, since these elements cooperate to distribute the stresses.

The lever furthermore optimally absorbs any stresses imparted transversely to the lever arm 7, since by virtue of the presence of the second lug 28 located proximate to the ends of the lever arm that is opposite to the one provided with the pair of pivots 10*a* and 10*b,* an optimum impact absorption that does not affect the pair of pivots 10*a* and 10*b* is achieved.

It has thus been observed that the invention has achieved the intended aim and objects, a lever having been obtained which allows to optimally absorb any impacts due to accidental contacts of the lever arm, for example with the snow, ice or ground on which the sport is practiced even if said lever arm is subjected either to axial or transverse forces.

The securing device according to the invention is furthermore structurally very simple and easy to industrialize.

The materials and the dimensions that constitute the individual components of the structure may naturally be the most pertinent according to the specific requirements.

I claim:

1. A securing device for fastening sports shoe traction elements comprising;

a baseplate (17) having a longitudinal extension and connectable to a sports shoe;

a lever arm (7) connectable, at an intermediate portion thereof to a sports shoe traction element (12), pivoting means (10*a,* 10*b,* 23*a,* 23*b*) at least temporarily pivotally connecting one end of said lever arm (7) to said baseplate (17);

safety connection means (14*a,* 14*b,* 15, 30*a,* 30*b,* 31) releasably connecting said lever arm (7) to said baseplate (17), at an opposite end of said lever arm (7) with respect to said pivoting means (10*a,* 10*b,* 23*a,* 23*b*), and;

means (8*a,* 8*b,* 28) for preventing lateral movement of said lever arm (7) with respect to said longitudinal extension of said baseplate (17), when said opposite end of said lever arm (7) is connected to said baseplate (17) by said safety connection means (14*a*, 14*b*, 30*a*, 30*b*), wherein said pivoting means (10*a*, 10*b*, 23*a*, 23*b*) comprise pivots (10*a*, 10*b*) connected to said lever arm (7), and curved teeth (23*a*, 23*b*) connected to said baseplate (17), said curved teeth (23*a*, 23*b*) at least temporarily rotatably accommodating said pivots (10*a*, 10*b*).

wherein said lever arm (7) comprises a single substantially U-shaped body defining two wings (8*a*, 8*b*), wherein said pivots comprise two coaxially aligned substantially cylindrical pivots (10*a*, 10*b*), one of said cylindrical pivots being connected to each of said wings (8*a*, 8*b*), wherein said curved teeth (23*a*, 23*b*) comprise a pair of curved teeth (23*a*, 23*b*) connected to said baseplate (17), said pair of curved teeth (23*a*, 23*b*) each defining a substantially S-shaped cross section, said securing device further comprising first inclined planes (24*a*, 24*b*) defined by said curved teeth (23*a*, 23*b*), and complementary shaped inclined planes (25*a*, 25*b*) defined on said lever arm (7) proximate to said two coaxially aligned substantially cylindrical pivots (10*a*, 10*b*), said first inclined planes (24*a*, 24*b*) being engagable in abutment engagement with said complementary shaped inclined planes (25*a*, 25*b*) when said opposite end of said lever arm (7) is connected to said baseplate (17) by said safety connection means (14*a*, 14*b*, 30*a*, 30*b* 31).

2. The combination according to claim 1, wherein said safety connection means ( 14*a*, 14*b*, 15, 30*a*, 30*b*, 31) comprise engagement protrusions (15) connected to said lever arm (7) and engageable with said means (8*a*, 8*b*, 28) for preventing lateral movement of said lever arm (7) with respect to said baseplate (17), and wherein said means (8*a*, 8*b*, 28) for preventing lateral movement of said lever arm (7) with respect to said baseplate (17) comprise wings (8*a*, 8*b*) defined by said lever arm (7), and a lug (28) connected to said baseplate (17) , said lug (28) being accommodated between said wings (8*a*, 8*b*) of said lever arm (7) when said opposite end of said lever arm (7) is connected to said baseplate (17) by said safety connection means ( 14*a*, 14*b*, 30*a*, 30*b*, 31).

3. The combination according to claim 2, wherein said safety connection means (14*a*, 14*b*, 15, 30*a*, 30*b*, 31) comprise recesses (31) formed on said lug (28), and wherein said engagement protrusions (15) connected to said lever arm (7) are releasably engageable in said recesses (31).

4. The combination according to claim 3, wherein said safety connection means (14*a*, 14*b*, 15, 30*a*, 30*b*, 31) further comprise shoulders (14*a*, 14*b*) protruding from said engagement arm (7) at an opposite end thereof with respect to said pivoting means (10*a*, 10*b*, 23*a*, 23*b*), and seats (30*a*, 30*b*) formed laterally on said lug (28), wherein said shoulders (14*a*, 14*b*) are accommodated in said seats (30*a*, 30*b*) when said engagement protrusions (15) are releasably engaged in said recesses (31).

5. The combination according to claim 4, wherein said engagement protrusions (15) are releasably engaged in said recesses (31) in a snap-together engagement relationship therewith.

6. In combination, a sports shoe (2) having an upper (3), mutually closeable members (5, 6) defined by said upper (3), a traction element (12) connected to one (5) of said mutually closeable members (5, 6), and a securing device (1) for tensioning said traction element (12), said securing device (1) comprising;

a lever arm (7) connected, at an intermediate portion thereof, to an end of said traction element (12), a baseplate (17) connected to another one (6) of said mutually closeable members (5, 6) and having a longitudinal extension;

pivoting means (10*a*, 10*b*, 23*a*, 23*b*) at least temporarily pivotally connecting one end of said lever arm (7) to said baseplate (17);

safety connection means (14*a*, 14*b*, 15, 30*a*, 30*b*, 31) for releasably connecting said lever arm (7) to said baseplate (17), at an opposite end of said lever arm (7) with respect to said pivoting means (10*a*, 10*b*, 23*a*, 23*b*), and;

means (8*a*, 8*b*, 28) for preventing lateral movement of said lever arm (7) with respect to said longitudinal extension of said baseplate (17), when said opposite end of said lever arm (7) is connected to said baseplate (17) by said safety connection means (14*a*, 14*b*, 30*a*, 30*b*), wherein said pivoting means (10*a*, 10*b*, 23*a*, 23*b*) comprise pivots (10*a*, 10*b*) connected to said lever arm (7), and curved teeth (23*a*, 23*b*) connected to said baseplate (17), said curved teeth (23*a*, 23*b*) at least temporarily rotatably accommodating said pivots (10*a*, 10*b*), wherein said lever arm (7) comprises a single substantially U-shaped body defining two wings (8*a*, 8*b*), wherein said pivots comprise two coaxially aligned substantially cylindrical pivots (10*a*, 10*b*), one of said cylindrical pivots being connected to each of said wings (8*a*, 8*b*), and wherein said curved teeth (23*a*, 23*b*) comprise a pair of curved teeth (23*a*, 23*b*) connected to said baseplate (17), said pair of curved teeth (23*a*, 23*b*) each defining a substantially S-shaped cross section, said combination further comprising first inclined planes (24*a*, 24*b*) defined by said curved teeth (23*a*, 23*b*), and complementary shaped inclined planes (25*a*, 25*b*) defined on said lever arm (7) proximate to said two coaxially aligned substantially cylindrical pivots (10*a*, 10*b*), said first inclined planes (24*a*, 24*b*) being engagable in abutment engagement with said complementary shaped inclined planes (25*a*, 25*b*) when said opposite end of said lever arm (7) is connected to said baseplate (17) by said safety connection means (14*a*, 14*b*, 30*a*, 30*b*, 31).

7. The combination according to claim 6, wherein said safety connection means (14*a*, 14*b*, 15, 30*a*, 30*b*, 31) comprise engagement protrusions (15) connected to said lever arm (7) and engageable with said means (8*a*, 8*b*, 28) for preventing lateral movement of said lever arm (7) with respect to said baseplate (17), and wherein said means (8*a*, 8*b*, 28) for preventing lateral movement of said lever arm (7) with respect to said baseplate (17) comprise wings (8*a*, 8*b*) defined by said lever arm (7), and a lug (28) connected to said baseplate (17), said lug (28) being accommodated between said wings (8*a*, 8*b*) of said lever arm (7) when said opposite end of said lever arm (7) is connected to said baseplate (17) by said safety connection means (14*a*, 14*b* 30*a*, 30*b*, 31).

8. The combination according to claim 7, wherein said safety connection means (14*a*, 14*b*, 15, 30*a*, 30*b*, 31) comprise recesses (31) formed on said lug (28), and wherein said engagement protrusions (15) connected to said lever arm (7) are releasably engageable in said recesses (31).

9. The combination according to claim 8, wherein said safety connection means (14*a*, 14*b*, 15, 30*a*, 30*b*, 31) further comprise shoulders (14*a*, 14*b*) protruding from said engagement arm (7) at an opposite end thereof with respect to said pivoting means (10*a*, 10*b*, 23*a*, 23*b*), and seats (30*a*, 30*b*) formed laterally on said lug (28), wherein said shoulders (14*a*, 14*b*) are accommodated in said seats (30*a*, 30*b*) when said engagement protrusions (15) are releasably engaged in said recesses (31).

10. The combination according to claim 9, wherein said engagement protrusions (15) are releasably engaged in said recesses (31) in a snap-together engagement relationship therewith.

* * * * *